United States Patent [19]

Vanderlaan

[11] 4,382,748

[45] May 10, 1983

[54] OPPOSED PISTON TYPE FREE PISTON ENGINE PUMP UNIT

[75] Inventor: Robert D. Vanderlaan, Kalamazoo, Mich.

[73] Assignee: Pneumo Corporation, Boston, Mass.

[21] Appl. No.: 203,813

[22] Filed: Nov. 3, 1980

[51] Int. Cl.[3] ..... F04B 35/00

[52] U.S. Cl. ..... 417/11; 417/314; 417/324; 417/341; 417/504

[58] Field of Search ..... 417/340, 341, 11, 62, 417/314, 349, 426, 427, 442, 504, 364, 380, 324; 123/46 R; 92/85 R, 85 A, 85 B

[56] References Cited

U.S. PATENT DOCUMENTS

| | | | |
|---|---|---|---|
| 1,722,425 | 7/1929 | Junkers | 123/46 R |
| 2,078,157 | 4/1937 | Pescara | 92/85 A X |
| 2,079,289 | 5/1937 | Janicke | 417/340 |
| 2,749,845 | 6/1956 | Bahniuk | 417/62 |
| 2,978,986 | 4/1961 | Carder et al. | 417/11 |
| 3,092,958 | 6/1963 | Duncan | 417/340 X |
| 3,125,282 | 3/1964 | Janicke | 417/340 |
| 3,129,878 | 4/1964 | Kosoff | 417/340 |
| 3,159,330 | 12/1964 | Boldt | 417/340 |
| 3,170,406 | 2/1965 | Robertson | 417/340 X |
| 3,432,088 | 3/1969 | Steiger | 123/46 B X |
| 3,606,591 | 9/1971 | Potma | 417/364 |
| 3,853,100 | 12/1974 | Braun | 417/340 |

*Primary Examiner*—Leonard E. Smith

*Attorney, Agent, or Firm*—Maky, Renner, Otto & Boisselle

[57] ABSTRACT

A free piston engine pump (FPEP) converts combustion energy into hydraulic power in an efficient, controlled and relatively uncomplicated manner, for example, for vehicle propulsion, auxiliary system power, etc. The FPEP is substantially naturally mass balanced having opposed engine pistons driving respective in-line hydraulic pumps. An adjustable accumulator with a deformable fluid-tight chamber containing a compressible fluid stores and delivers energy for compression, and an arrangement of control valves and check valves enables selective operation of the FPEP in primary (high flow) and secondary (high pressure) modes. Plural FPEP's may be interfaced for parallel operation sharing common elements and functions. Cycle rate, intermittent operation and start-up also may be controlled. Electronic monitoring and control of one or more operational parameters of a FPEP also are disclosed.

51 Claims, 17 Drawing Figures

OPPOSED PISTON TYPE FREE PISTON ENGINE PUMP UNIT

BACKGROUND OF THE INVENTION

The present invention relates generally to a hybrid power system for generating pressurized hydraulic power and, more particularly, to free piston engine pumps in which energy of combustion of a power cylinder is converted into hydraulic energy.

In a free piston engine pump (hereinafter abbreviated FPEP) the motion of the engine piston(s) is at least substantially directly delivered to hydraulic pumping elements, usually, without crankshaft and connecting rod arrangements of conventional rotary engines. The hydraulic power developed may be used for vehicle propulsion and auxiliary equipment operation as well as for other purposes.

The present invention is concerned with optimizing the efficiency of a FPEP and providing versatility and facility of operation and use thereof.

SUMMARY OF THE INVENTION

The FPEP of the present invention includes an engine for producing mechanical work during a power stroke and a pump responsive to the engine work for pumping fluid during the power stroke. According to one aspect of the invention the intake ports and exhaust ports of the engine combustion chamber are at opposite ends thereof resulting in unidirectional or uniflow scavenging of the engine cylinder. According to another aspect, valving controls hydraulic input and output paths of the pump to permit selective operation in a primary high flow and a secondary high pressure mode of operation, preferably while maintaining substantially constant the product of output pressure and flow; the valving also may be employed selectively to control cycle rate, i.e. the number of cycles per unit time, starting either in the primary mode or secondary mode, intermittent cycling, and compression energy boost. According to another aspect, pumping may be effected during the entire power stroke and in the normal operating region compression energy is supplied during the entire compression stroke.

A deformable bladder-type compression accumulator may be used for storing energy during the power stroke and returning the same for compression; such accumulator contains a compressible fluid the pressure of which is controllably adjustable to control compression energy. According to another aspect, total control of the energy put into compression to establish compression ratio and the related pressure and temperature condition in the cylinder enable optimization of engine efficiency minimizing compression losses and controlling operating pressure profile in the engine cylinder; moreover, the rate at which compression energy is applied may be controlled to establish the velocity and acceleration profiles of the engine pistons during compression stroke enabling cycle rate variability.

Other aspects of the invention include synchronizing the pistons of an opposed piston type of FPEP preferably without ordinarily substantially loading the synchronization apparatus; acceleration boost of the pistons at the start of a compression stroke; an energy absorber for excessive energy during an abnormal power stroke; and a reset valve and actuator arrangement for a FPEP. Still additional aspects relate to control features whereby a plurality of engine and/or pump parameters may be monitored electronically and operation accordingly electronically controlled and to the interfacing or pairing of plural FPEP's resulting in reduced pressure pulsations, versatility allowing less than all of the FPEP's to operate at a given time, and general efficiency by combining elements and functions.

With the foregoing in mind, a principal object of the present invention is to provide a free piston engine pump and associated equipment improved in the noted respects.

Another object is to provide an improved system for generating hydraulic power, e.g. for vehicle propulsion or auxiliary equipment operation and the like.

Another object is to convert combustion energy into hydraulic power in an efficient, controlled, versatile and relatively uncomplicated manner, and especially to effect the same in a FPEP.

Other objects are to minimize cost, to improve efficiency and operation, and to minimize the size and weight of a FPEP.

Another object is to improve the output characteristics and efficiency of a FPEP system, e.g. by effecting pumping over the entire power stroke and/or by coupling multiple FPEP's in parallel preferably while sharing common elements and functions.

Another object is to provide the ability to withstand unusually high peak cylinder combustion pressures.

Another object is to provide natural mass balancing and to minimize vibration in a FPEP.

Another object is to synchronize piston pairs in a FPEP of the opposed piston type preferably without substantially loading the synchronizing equipment.

Another object is to facilitate the control and to improve the versatility of control of a FPEP.

Another object is to enable dual mode pumping rate capability of a FPEP efficiently and quickly to accommodate the requirements of a hydraulic system.

Another object is to interface multiple FPEP's, especially while synchronizing the same, for optimum efficiency and versatility of operation, e.g. by combining the elements and functions and reducing pressure fluctuations and other losses.

Another object is to provide a constant cycle period in a FPEP both in start and various run modes, especially to facilitate tuning the exhaust system for optimum use of exhaust gas inertia.

Another object is to facilitate starting a FPEP.

Another object is to control the cycle rate, intermittent operation and start-up of a FPEP.

Another object is to improve efficiency of storage and delivery of compression energy, especially by providing a gas-oil accumulator which preferably is adjustable.

Another object is to minimize the number of dynamic seals required and the loading thereof in a FPEP.

Another object is to control compression energy, compression ratio and compression energy rate profile during operation of a FPEP.

Another object is to increase the cycle rate capability of a FPEP, especially by providing additional energy for increasing piston acceleration at the start of a compression stroke and increasing the deceleration of the piston mass at the end of the power stroke.

Another object is to regulate cycle-by-cycle operation of a FPEP thereby to optimize performance, to achieve constancy, and to obtain versatility, and especially to effect the same using electronic controls.

Another object is to control the peak combustion pressure levels while maintaining high thermal efficiency.

These and other objects, advantages, features and aspects of the invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
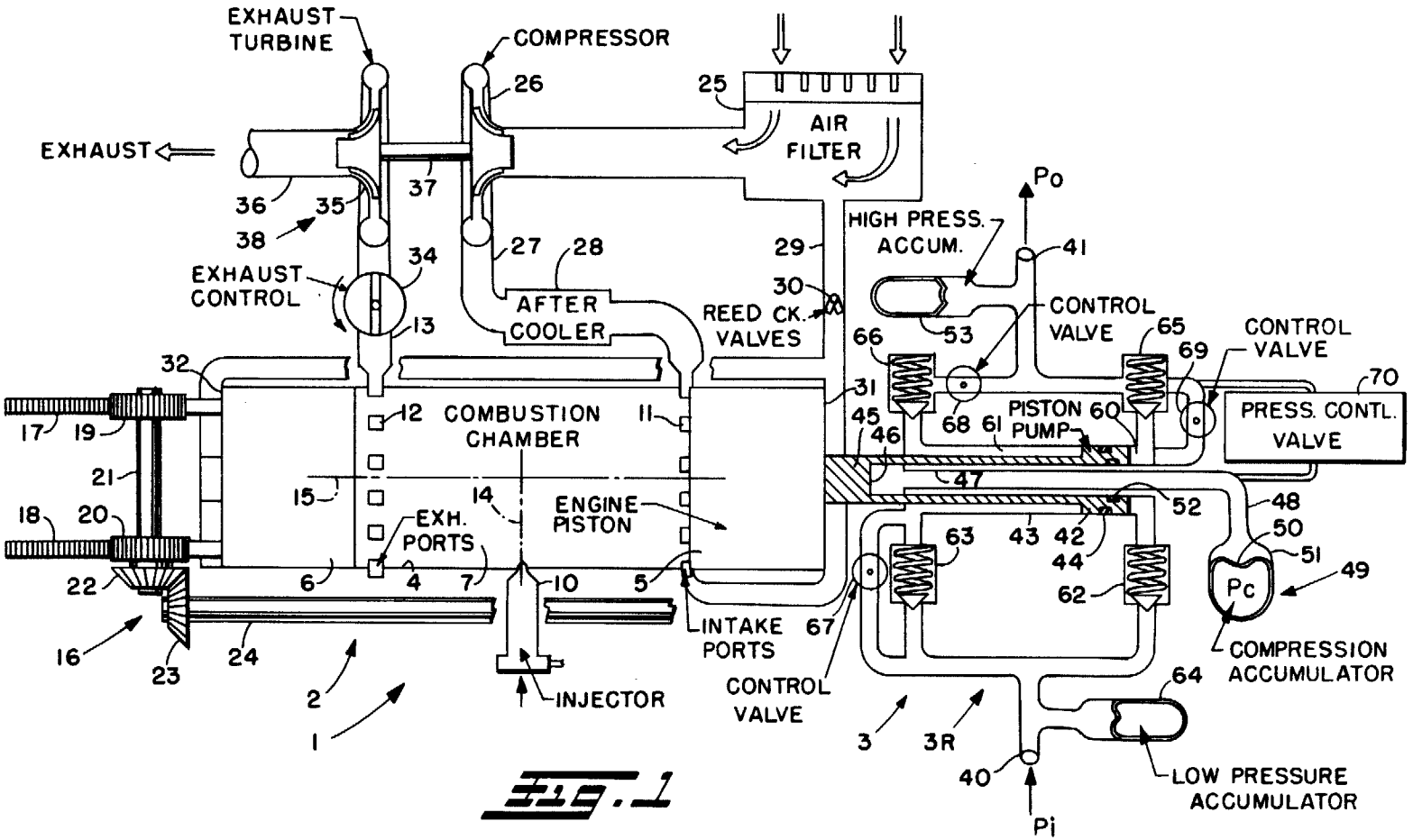
FIG. 1 is a schematic diagram of a FPEP in accordance with the present invention.

Referring now in detail to the drawings, wherein like reference numerals designate like parts in the several figures, and initially to FIG. 1, a FPEP in accordance with the invention is generally illustrated at 1. The FPEP 1 has an engine portion 2 and hydraulic pump portion 3.

The engine portion 2 includes an engine cylinder 4 in which a pair of engine pistons 5, 6 move linearly or axially and between which a combustion chamber 7 is formed. In the course of a compression stroke a fuel injector 10 injects fuel into the combustion chamber 7. Air intake ports 11 at the righthand end of the combustion chamber provide passage for air into the same, and exhaust ports 12 at the opposite end of the combustion chamber 7 permit exhaust gases to exit via an exhaust line 13. With the intake and exhaust ports 11, 12 located at opposite ends of the combustion chamber 7, uniflow or unidirectional scavenging is achieved.

The engine portion 2 is of the opposed piston type, whereby during a compression stroke the engine pistons 5, 6 are urged toward each other in the cylinder 4 reducing the size of the combustion chamber 7 and, therefore, increasing the pressure and temperature therein to effect compression ignition of the fuel injected by the fuel injector 10, thereby to initiate a power stroke. During the power stroke, the engine pistons 5, 6 are driven by the energy of combustion oppositely axially in the cylinder 4. When the engine piston 6 opens the exhaust ports 12, the exhaust products will exit the combustion chamber via the exhaust line 13, and when the engine piston 5 subsequently opens the intake ports 11, air will enter the combustion chamber 7 to effect the desired scavenging after which the next compression stroke usually will commence.

Preferably the engine pistons 5, 6 are of equal mass and those parts of the engine portion 2 movable with the engine piston 5 are of a mass equal to those parts movable with the engine piston 6 thereby effectively naturally to mass balance the engine portion 2 about a centerline 14, which is perpendicular to the linear axis 15 of the engine portion. Further assisting in the mass balancing of the engine portion 2 and maintaining substantial uniformity in operation thereof are synchronizers 16 mechanically interconnecting the engine pistons 5, 6. Each synchronizer 16 includes a pair of racks 17, 18 connected to the engine piston 6 for linear movement therewith and a pair of pinion gears 19, 20 for rotation by the respective racks. The pinion gears 19, 20 are coupled by a shaft 21, which rotates with the pinion gears and is in turn coupled via a pair of bevel gears 22, 23 to turn a coupling shaft 24. The coupling shaft 24 in turn in connected to a similar arrangement of racks, pinion gears, shaft and bevel gears like those identified by the reference numerals 17–23 associated with the engine piston 5. Compression energy during a compression stroke is preferably applied by both engine pistons 5, 6 independently of the synchronizer 16, and during a power stroke the energy of combustion directly urges both engine pistons 5, 6 relatively outwardly in the cylinder 4. The synchronizer 16 desirably effects its synchronizing operation generally maintaining a balanced uniform operation and movement of the engine pistons 5, 6 usually without any appreciable mechanical loading or forces on the various components of the synchronizer 16.

Air to support combustion passes through an air filter 25, is compressed by a compressor 26 and is delivered usually at several, preferably as much as three, atmospheres pressure via air line 27 and intake ports 11 into the combustion chamber 7. An after cooler 28 in the air line 27 provides a cooling or heat exchange function, vis-a-vis the inlet air and the combustion chamber. Moreover, air entering the air filter 25 also may pass via air line 29 and one or more reed check valves 30 to the back side chamber 31, 32 of each engine piston 5, 6, being drawn there during a compression stroke and being pressurized during a power stroke and, accordingly, forced at the end of a power stroke through the intake ports 11 further supercharging operation of the engine portion 2 in cooperation with the pressurizing function of the compressor 26.

The exhaust products of combustion exiting the combustion chamber 7 via the exhaust line 13 pass through an exhaust control valve 34, exhaust turbine 35 and exhaust line 36 for discharge in conventional manner. The exhaust turbine 35 drives the compressor 26 via the shaft 37, as shown. Moreover, as will be described further below, in the preferred embodiment each cycle of operation of the engine portion 2, including a compression stroke and a power stroke, preferably is substantially uniform to enable relative tuning of the exhaust system 38 for optimum utilization of the energy contained in the exhaust products of combustion.

For efficiency and facility of description, only the righthand half 3R of the hydraulic pump portion 3 is illustrated in FIG. 1 and will be described in detail below associated with the engine piston 5; the other half 3L of the hydraulic pump portion 3, schematically shown in FIG. 13, may be substantially identical to that described. Control of both halves of the hydraulic pump portion 3 preferably will be simultaneously parallel. The inlet hydraulic fluid line 40 and the outlet hydraulic fluid line 41 associated with the righthand pump half 3R preferably would be coupled to a hydraulic system, not shown, in parallel fluid relation with the lefthand pump half 3L. In the external hydraulic system, not shown, relatively low pressure inlet hydraulic fluid at pressure $P_i$ is directed to the inlet hydraulic fluid line 40, and the hydraulic pump portion 3 pumps hydraulic fluid at relatively high pressure $P_o$ via the outlet hydraulic fluid line 41 for use in the external hydraulic system.

Referring in detail to the illustrated pump half 3R, the same includes a pump piston 42 slidably movable in a pump cylinder 43 in sealed relation thereto using a single conventional sliding seal 44. A rod or shaft 45 mechanically connects the pump piston 42 with the engine piston 5 for linear in-line reciprocation therewith. Also slidable with the pump piston 42 and preferably formed, as illustrated, integrally therewith and with the rod 45 is a compression piston 46 slidable with respect to a compression cylinder 47. A compression fluid flow line 48 extends between the compression cylinder 47 and the compression accumulator 49. It is the purpose of the compression piston 46 and compression accumulator 49 to store compression energy, i.e. energy required to effect a compression stroke, during a power stroke and subsequently to deliver such compression energy to the engine piston 5 to effect such compression stroke after a power stroke has been completed.

In the compression accumulator 49 a deformable bladder-like member 50 contains a compressible fluid, such as an inert gas or other gas; the bladder 50 in turn is contained in a rigid accumulator housing 51. During a power stroke hydraulic fluid in the compression fluid flow line 48 is pumped by the compression piston 46 into the accumulator housing 51 effecting a deforming of the bladder 50 to compress the gas therein thereby storing compression energy. During a compression stroke the compression energy stored in the compressed gas in the bladder 50 is delivered via the hydraulic fluid in flow line 48 urging the compression piston 46 and, thus, the engine piston 5 to move toward the left in a compression stroke. Since the cyclic transfer rate of fluid into and out of the compression accumulator 49 is very fast, the energy exchange is virtually adiabatic and thermal losses are negligible. Additionally, only one seal 52 is needed to isolate output pressure from compression accumulator pressure, thus reducing the net frictional force loss per cycle due to seal requirements. The seal 52 provides the desired isolation in that during both a normal power stroke and the compression stroke in the secondary mode of operation the pressure in the high pressure output accumulator 53 and compression accumulator 49 are preferably approximately equal. Although during the compression stroke in the primary mode of operation a differential pressure of $P_C$ (the pressure in the bladder 50) minus $P_i$ does exist across the seal 52, such differential pressure preferably will be relatively small and ordinarily certainly less than one containing ambient pressure as a term.

At the front or pressure side of the pump piston 42 is a first pump chamber 60, and at the back side of the pump piston 42 is a second pump chamber 61. Inlet check valves 62, 63 supply low pressure $P_i$ fluid in the flow direction shown from the inlet hydraulic fluid line 40. A low pressure accumulator 64 coupled to the inlet hydraulic fluid line 40 stores inlet hydraulic fluid for supply to the hydraulic pump portion 3 while also minimizing pressure pulsations of the inlet fluid. Outlet check valves 65, 66 are coupled at chambers 60, 61 to the outlet hydraulic fluid line 41 and high pressure accumulator 53. Three selectively operable control valves 67–69 are used to control the operation of the hydraulic pump portion 3, as will be described in greater detail below. The valves 67–69 preferably either are electrohydraulically or mechanically actuated and provide large passageways through which fluid may flow thereby to effect rapid operation to flow opening or closing and to avoid pressure losses; the preferred valve is a ball type in-line valve. Conventional pressure control valves 70 are coupled to the fluid flow lines illustrated to relieve excess and otherwise to alter fluid pressure, if needed.

In the hydraulic pump portion 3 pumping preferably is accomplished during the entire power stroke and compression energy is applied preferably during the entire compression stroke. The primary pumping element is the pump piston 42 with the minimum number of seals illustrated. In the most efficient mode of operating the hydraulic pump portion 3 high pressure hydraulic fluid is pumped out on the power stroke and drawn in on the compression stroke by action of the arrangement of check valves illustrated. Check valve closing occurs preferably only at the ends of the stroke where piston velocity decreases uniformly to zero. As a result, the valves have a natural decreasing flow profile so that when piston motion stops the valve is immediately seated thereby eliminating a tendency for backflow leakage when piston motion reverses. Moreover, output and input flow rates are continuous throughout the strokes with no discontinuity associated with alternate techniques that change energy in discrete levels during the strokes. Full stroke pumping also reduces the peak hydraulic flow rate passing through the check valves and various flow passages thereby reducing hydraulic losses.

During each complete cycle of operation of the FPEP 1, the hydraulic pump portion 3 supplies energy for effecting a compression stroke to bring the engine pistons 5, 6 toward one another thereby to effect compression admission of fuel and air in the combustion chamber 7. Thereafter, the energy of combustion drives the engine pistons 5, 6 relatively outwardly to expand the combustion chamber 7 in a power stroke during which fluid is pumped by the hydraulic pump portion, as now will be described in detail. The hydraulic pump portion 3 has two distinct modes of operation, namely a primary high flow rate mode, which normally is used and is the more efficient mode of operation, and a secondary high pressure mode, depending on the setting of the control valves 67, 68, and 69.

Figure 2A:
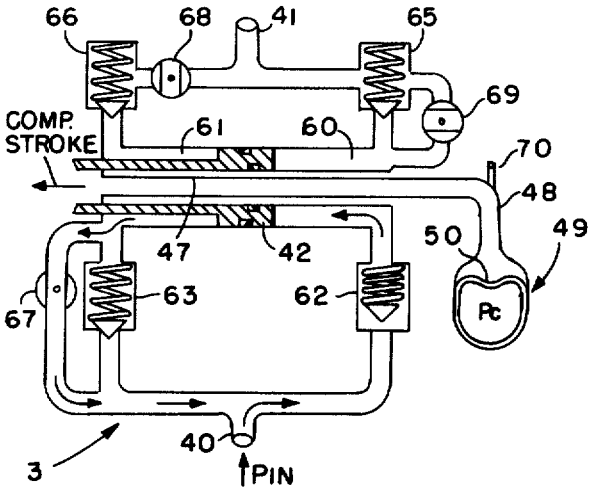
FIGS. 2A and 2B are fragmentary schematic illustrations of the FPEP of FIG. 1 operative in compression and power strokes in the primary high flow rate mode.
Figure 2B:
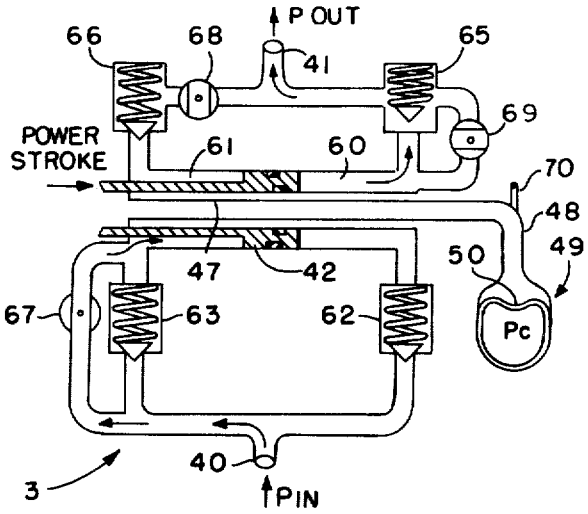

Referring now to FIGS. 2A and 2B, operation of the FPEP 1 and particularly the hydraulic pump portion 3 in the primary high flow rate mode is illustrated. In the primary mode the control valve 67 is open and the control valves 68, 69 are closed. During the compression stroke shown in FIG. 2A, energy stored in the form of compressed gas in the compression accumulator 49 is delivered via the hydraulic fluid in the compression fluid flow line 48 to drive the compression piston portion 46 of the pump piston 42 and, thus, the engine piston 5 to the left relative to the illustration effecting compression in the combustion chamber 7. On the compression stroke hydraulic fluid enters the first pump chamber 60 via the inlet check valve 62 while a lesser amount of fluid exits from the second pump chamber 61 via the open control valve 67. Subsequently on the power stroke shown in FIG. 2B, high pressure fluid is pumped by the pump piston 42 and exits the first pump chamber 60 via the outlet check valve 65 as relatively low pressure fluid returns to the second pump chamber 61 via the open control valve 67. The inlet fluid provided via the inlet hydraulic fluid line 40 is desirably at relatively low pressure preferably stabilized by the low pressure accumulator 64 (FIG. 1), and the hydraulic fluid pumped from the first pump chamber 60 to the outlet hydraulic fluid line 41 will be at relatively higher pressure and may be used to do work in external equipment, not shown, or may be stored in the high pressure accumulator 53.

Figure 3A:
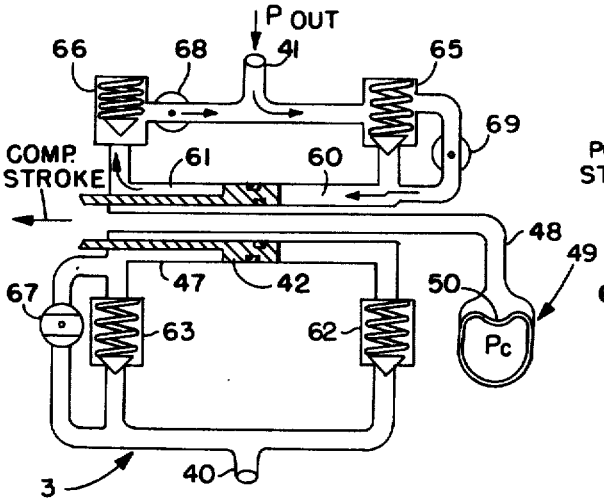
FIGS. 3A and 3B are fragmentary schematic illustrations of the FPEP of FIG. 1 operative in compression and power strokes in the secondary high pressure mode.
Figure 3B:
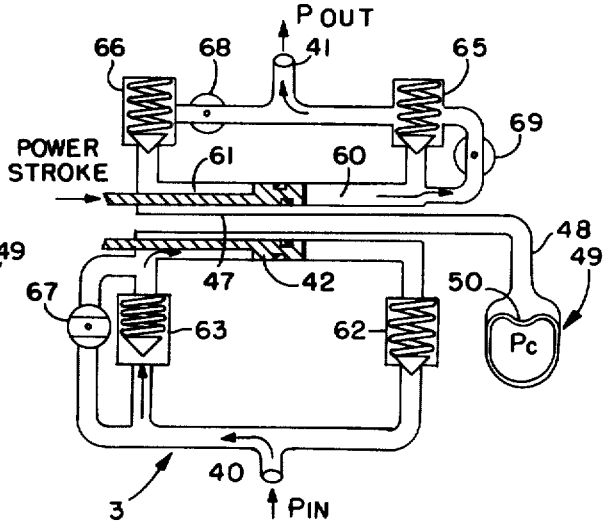

In the secondary or high pressure mode of operation illustrated in FIGS. 3A and 3B, the control valve 67 is closed and the control valves 68 and 69 are open. On the compression stroke shown in FIG. 3A high pressure fluid enters the first pump chamber 60 through the open control valve 69 and high pressure hydraulic fluid also exits the second pump chamber 61 via the outlet check valve 66 and open control valve 68. Since the area of the pump piston 42 exposed in the first pump chamber 60 exceeds that exposed in the second pump chamber 61, the just-described flow of fluid will effect a net energy or work input during the compression stroke to supplement the compression energy provided by the compression accumulator 49, as was described above with reference to FIG. 2A. However, in the secondary mode, the pressure level $P_C$ in the compression accumulator 49 preferably would be reduced substantially in order to minimize losses, whereupon the principal compression energy is delivered from the outlet hydraulic fluid line 41.

On the subsequent power stroke the compression energy (less losses) is returned to the output system by the pumping action of the piston 42. More particularly, as is shown in FIG. 3B, during the power stroke inlet fluid enters the second pump chamber 61 through the inlet check valve 63 and high pressure fluid is transferred to the outlet hydraulic fluid line 41, external load, not shown, and high pressure accumulator 53 as established by the volume of the first pump chamber 60. Accordingly, the net amount of useful work produced by the combustion energy in the FPEP 1 operating in the secondary mode is related to the net pumped high pressure fluid from the first pump chamber 60.

The primary and secondary modes of operation may be compared assuming, for example, equal power input level for both modes of operation whereby the net hydraulic output work must be the same for both modes, disregarding losses. The output work in each mode is proportional to the product of pressure times flow and input work equals output work. Therefore, if the volume of the first pump chamber 60 is twice that of the second pump chamber 61, the output pressure capability of the secondary mode of operation will be twice the pressure capability in the primary mode of operation.

Figure 4:
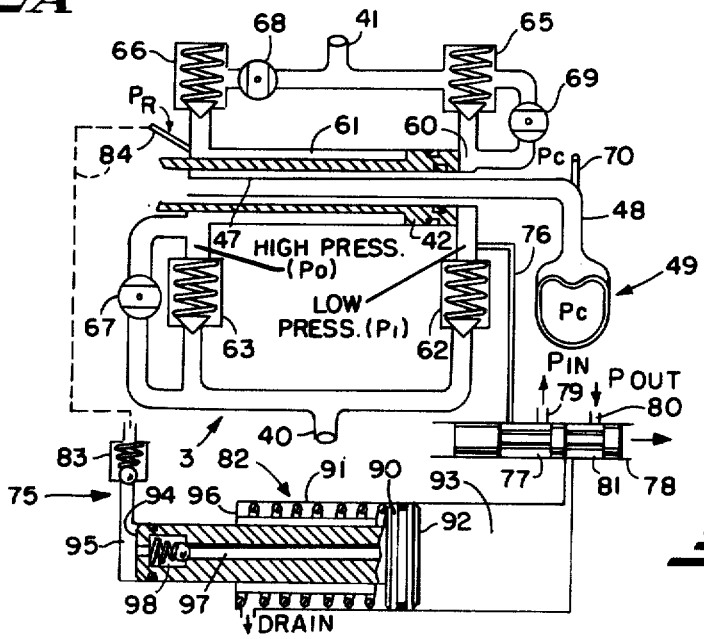
FIG. 4 is a fragmentary schematic view of the FPEP of FIG. 1 in combination with a reset valve and actuator.

For starting the FPEP 1 a reset mechanism 75 associated with the pump half 3R, the other pump half 3L also having a similar reset mechanism or connections to the one shown, is operated to position the engine pistons 5, 6 and pump pistons 42 outward, as is illustrated, for example, in FIG. 4. Such outward positioning is accomplished by venting the fluid in the first pump chamber 60 to inlet pressure level $P_i$ by a connection effected through hydraulic fluid line 76, chamber 77 of a selectively adjustable reset spool valve 78 and fluid line connection 79, which is connected to the low pressure accumulator 64, for example. At the same time fluid pressure in the second pump chamber 61 is raised by supplying high pressure fluid from an external source (not shown) via fluid line connection 80, chamber 81 of the reset spool valve 78, reset actuator 82, check valve 83 and hydraulic fluid line 84, thereby providing adequate pressure to force the pistons outward against the resisting force of the compression accumulator 49.

More specifically, to use the reset spool valve 78 and reset actuator 82 of the reset mechanism 75 to effect starting of the FPEP 1, the inlet $P_i$, outlet $P_o$, and compression accumulator $P_C$ pressure levels must first be established by conventional means which are not part of this disclosure. In the preferred embodiment and best mode the FPEP 1 is designed to start at minimum operating pressure level of, for example, 2,000 psi or greater. After the minimum pressure level for start-up has been established, a force level great enough to overcome the compression accumulator pressure acting over the surface area of the compression piston 46 as well as all frictional forces is required to move the engine and pump pistons to the position illustrated in FIG. 4 ready for the beginning of a compression stroke. Moreover, in order to generate a relatively high level of compression energy for cold start requirements, a relatively high level of compression accumulator pressure $P_C$ is desirable. The reset actuator 82 provides the necessary force level for effecting the desired resetting of the pistons.

The reset actuator 82 is a form of hydraulic pressure intensifier including an actuator piston 90 movable in a stepped cylinder 91 and having a relatively large surface area 92 exposed in a fluid chamber 93 and a relatively small surface area 94 exposed in a fluid chamber 95. A spring 96 ordinarily biases the actuator piston 90 to a righthand position (not shown) in the stepped cylinder 91 when out of use. A fluid flow path 97 through the actuator piston 90 and a check valve 98 therein provide unidirectional fluid flow coupling of the fluid chambers 93, 95. The reset actuator 82 is sized so that the total displaceable volume of the second pump chamber 61 is somewhat less than the total displaceable volume of the fluid chamber 95. Additionally, the large surface area 92 of the actuator piston 90 is greater than that of the small surface area 94 by an amount which is adequate to overcome the load of the spring 96, frictional forces, and the force due to pressure in the second pump chamber 61 to reset the pump piston 42 to the position illustrated in FIG. 4, i.e. against the compression force, i.e. the product of $P_C$ times the area of the compression piston 46.

When resetting occurs, the reset valve 78 is positioned as shown in FIG. 4. The first pump chamber 60 is then vented to low pressure $P_i$ and the reset actuator 82 is supplied with high pressure $P_o$. The actuator piston 90 is driven toward the lefthand position shown in FIG. 4 forcing fluid from the fluid chamber 95 into the second pump chamber 61 driving the pump piston 42 and engine piston 5 to the righthand position shown in FIG. 4. When the pump piston 42 has fully reset, as may be sensed by a position sensor described in detail below with reference to FIG. 13, for example, the spool of the reset valve 78 is moved in its cylinder to the right blocking communication with the first pump chamber 60 and venting the reset actuator fluid chamber 93 to low pressure $P_i$. The fluid flow path 97 and check valve 98 then permit the spring 96 to move the actuator piston 90 to its maximum righthand position while the fluid chamber 95 is refilled with fluid and the check valve 83 isolates the pump from the chamber 95.

In the reset position illustrated in FIG. 4 the FPEP 1 is ready for starting cycle initiation. Moreover, the illustrated position and setting of the several control valves 67–69 is the "hold" condition between cycles when the FPEP 1 is operated in an intermittent manner.

To initiate operation of the FPEP 1, then, relative to the condition illustrated in FIG. 4, the control valve 67 is opened quickly thereby venting the high pressure in the second pump chamber 61 to low inlet pressure level, whereupon compression energy from the compression accumulator 49 effects a compression stroke commencing cyclical operation in the primary mode.

During start-up and especially when starting and "warming up" at especially cold temperature extremes, it is desirable substantially to raise the compression energy. Such increase in compression energy may be accomplished initially by raising the pressure $P_C$ in the hydraulic accumulator 49, and particularly of the fluid (preferably a compressible gas) in the bladder 50, to a predetermined level followed by the above-described resetting sequence and operation initiation with an initial compression stroke. Furthermore, if even higher start-up compression is desired, the control valve 69 may be opened during the initial compression stroke and is left open until it is desired to effect operation specifically in the primary or secondary modes described above. After normal operation is under way and the FPEP 1 is satisfactorily warm, the compression accumulator pressure $P_C$ may be reduced somewhat to lower unnecessary compression energy losses.

If it is desired to start operation of the FPEP 1 in the secondary mode, the above noted resetting would be effected initially. Thereafter, to initiate a compression stroke, while maintaining the control valve 67 closed, the control valve 68 first is opened, and promptly thereafter the control valve 69 is opened. The FPEP 1 accordingly would be configured for operation in the secondary mode of operation for succeeding cycles, as is described above with reference to FIGS. 3A and 3B.

The FPEP 1 can be made to vary its cycling frequency from a maximum down to rates as low as a few cycles per minute. Such cycling frequency control is accomplished by interrupting the normal cycling motion at the end of a power stroke with a pause period. Each cycle in itself is a full velocity cycle in both compression and power stroke directions. Interruption occurs at the end of a power stroke to create a pause period until the interruption is terminated, and the interruption process is brought about by valving operation, as will now be described.

In the primary mode, during a power stroke, the control valves 67, 68 are closed. Therefore compression stroke motion is not permitted to begin because of the pressure lock that is formed in the second pump chamber 61, and, accordingly, the normal cycling frequency is interrupted. When the pump portion 3 is held in this position, pressure in the first pump chamber 60 drops to a low pressure while pressure in the second pump chamber 61 increases until a force balance is established. To initiate the next cycle, the high pressure fluid in the second pump chamber 61 is released to low pressure by opening control valve 67. Accordingly, intermittent cycling is accomplished in the primary mode by use of the control valve 67. Moreover, during such intermittent cycle operation, the inlet check valve 63 is active or passes fluid on the power stroke to provide a supply into the second pump chamber 61, and, therefore, the control valve 67 does not have to close particularly fast during the power stroke, although its closure should be completed by the end of the power stroke.

If it is desired to reduce the cycle rate in the secondary mode of operation, both control valves 68 and 69 must be sequentially actuated to open the same. More particularly, on a power stroke the control valves 68 and 69 are closed and fluid fills the second pump chamber 61 via the inlet check valve 63 and exits the first pump chamber 60 at high pressure through the outlet check valve 65. Compression stroke motion will be prevented by the pressure lock formed in the second pump chamber 61. To initiate the next cycle of operation, control valve 68 is first opened followed by opening of control valve 69 to initiate a compression stroke.

Figure 5A:
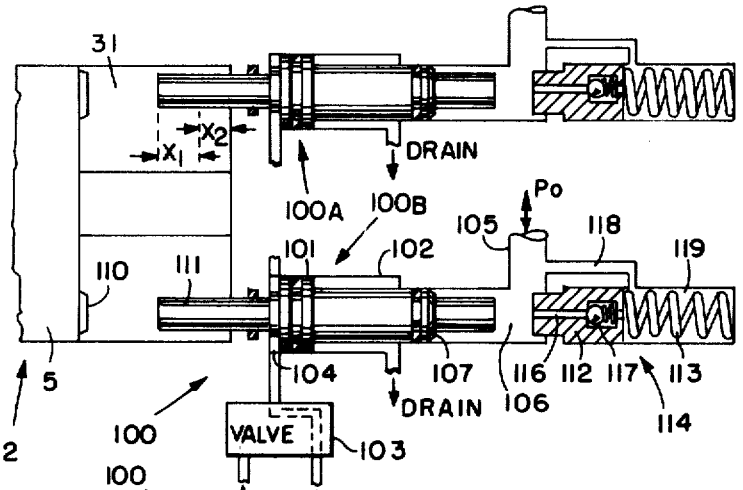
FIGS. 5A and 5B are fragmentary schematic views of the FPEP of FIG. 1 illustrating acceleration boost and energy absorber features.
Figure 5B:
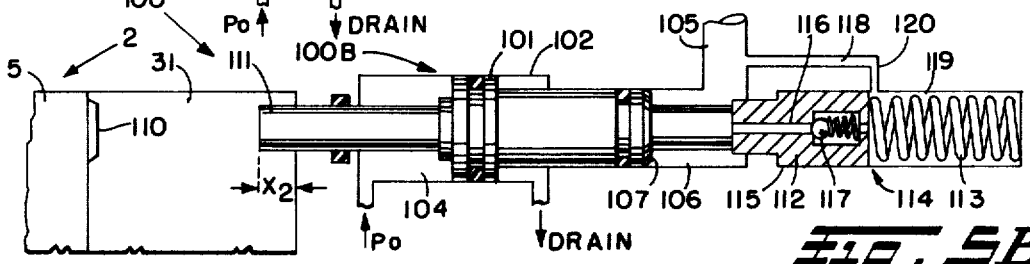

Turning now more particularly to FIGS. 5A and 5B, acceleration boost and energy absorber features of the invention are illustrated. The acceleration booster 100 includes two substantially identical portions 100A, 100B shown in operative condition in FIG. 5A. The acceleration booster 100B, for example, includes a boost piston 101 slidable in a cylinder 102. When valve 103 ports chamber 104 to return pressure, output pressure at port 105 acting on the exposed surface area of boost piston 101 in chamber 106 moves the boost piston to the lefthand position shown in FIG. 5A. At the end of a power stroke a pad 110 on the back side of the engine piston 5 engages the rod 111 of the boost piston 101 driving the same to the right causing an outflow of high pressure fluid from the chamber 106 via the port 105. Since the surface area of the boost piston 101 exposed in chamber 106 is larger than the surface area of the rod 111 exposed in the back side chamber 31 of the engine portion 2, the engine piston 5 will decelerate to zero more rapidly than would be expected to occur without the acceleration booster 100 activated. The area 107 times the pressure in the chamber 106, i.e. output pressure $P_o$, will be the force tending to expedite such deceleration. The same pressure force provides quick acceleration during the beginning of the subsequent compression stroke. The net result is that both power and compression stroke time periods are shortened and the resultant cycle and delivery rates are increased.

To activate the acceleration booster 100, the valve 103 ports the chamber 104 to output pressure $P_o$ urging the boost piston 101 to the right in its cylinder 102 until it engages the energy absorber piston 112. The area of the boost piston 101 exposed in chamber 104 is slightly larger than the area 107 exposed in chamber 106 so that the boost piston has adequate retraction force to the position shown, for example, in FIG. 5B but does not compress the heavy absorber piston spring 113.

Referring to FIG. 5B, there is illustrated one of the portions 100B of the acceleration booster 100 of FIG. 5A along with the energy absorber 114, including the absorber piston 112 and spring 113. The absorber 114 also includes a fluid-tight cylinder 15 in which the spring 113 is contained and the absorber piston 112 may slide. A fluid passage 116 and check valve 117 are contained in the absorber piston 112, and a fluid path 118 between the chamber 119 in the cylinder 115 and the output port 105 conducts fluid therebetween as permitted by the absorber piston 112.

In the abnormal event that the energy of combustion substantially exceeds the amount of hydraulic energy removed during a power stroke, the several piston elements, including the engine pistons and pump pistons, are protected against bottoming forces that could cause structural damage by separate energy absorbers 114 associated with each acceleration booster portion of each engine piston 5, 6 which provide such energy absorbing function. Each energy absorber 114 also includes a high force liquid spring to decelerate the piston masses and absorb the excessive energy. The absorber pistons 112 are closely fit to their respective cylinders 115. The check valve 117 and fluid passage 116 ensure that all air is removed from the liquid spring chamber 119. The fluid path 118 includes an orifice 120 closed by the absorber piston 112 promptly after retraction motion of the latter commences. Accordingly, if the engine piston 5 contacts the rod 111 of the boost piston 101 on a power stroke, a resistive high rate liquid spring force will be developed to stop the piston motion. The available travel for such energy absorbing function is the distance $X_2$ shown in FIG. 5B. such travel and energy absorption also is available after the acceleration boost piston 101 may have traveled a distance $X_1$ when the acceleration booster 100 is activated.

A plurality of FPEP's 1 may be combined to increase power output and to add flexibility of operation. If desired, only a single FPEP of a combined group may be operated at a time, for example when hydraulic damands are low, or all of the FPEP's may be operated.

Figure 6:
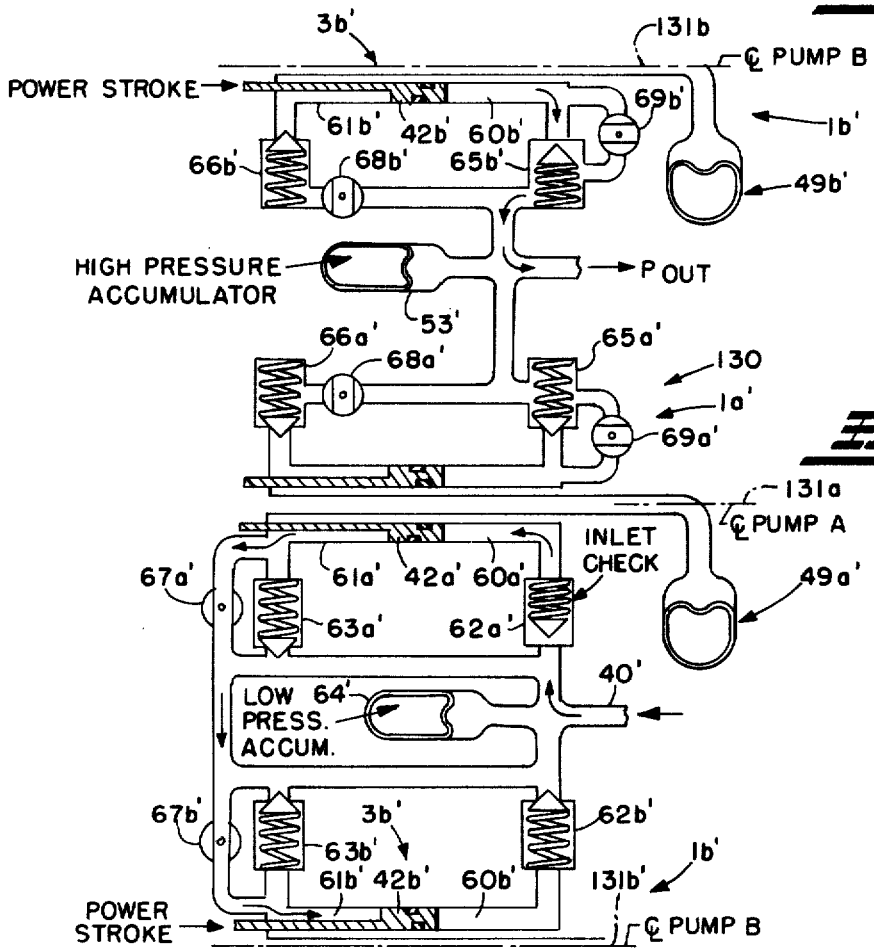
FIG. 6 is a fragmentary schematic view of a pair of FPEP's interfaced for operation together in the primary mode, although adjustable by appropriate valve adjustments to operate in the secondary mode.

Turning to FIG. 6, a grouped, here paired, FPEP system 130 includes a FPEP 1*a'* and a FPEP 1*b'*, each of which is substantially the same in form and operation as the FPEP 1 described above. In FIG. 6 primed reference numerals designate parts having the same or similar form and function as those designated by the same unprimed reference numerals in FIG. 1.

When pairing FPEP's in accordance with the invention, it is desirable to combine some specific pump elements and functions to improve pumping efficiency and to reduce pressure pulsations normally associated with piston pumps. In the system 130 of FIG. 6 the high and low pressure accumulators 53', 64' are shared to reduce flow losses and space requirements; as a result there is a net gain in output efficiency over a single FPEP. The FPEP's 1*a'*, 1*b'* are positioned about respective centerlines 131*a*, 131*b*, which are parallel and for the sake of clarity, the line 131*b* appears at the top and at the bottom of FIG. 6, with the pump piston and chambers of the hydraulic pump portion 3*b'* thereof being divided as shown. The FPEP's 1*a'*, 1*b'* have interacting elements, valving and porting between the two pumps in a side-by-side installation, and such FPEP's are made preferably to cycle alternately by the electronic control system described below with reference to FIG. 13.

In the system 130 flow is ported directly to the adjacent pump through the control valves 67*a'*, 67*b'* interconnecting the second pump chambers 61*a'*, 61*b'* allowing fluid to pass freely between such second pump chambers with negligible pressure losses. Additionally, the control valves 67*a'*, 67*b'* function to isolate the FPEP's 1*a'*, 1*b'* when acting independently as well as to provide a conversion between primary and secondary modes of operation In the primary mode of operation shown in FIG. 6, the inlet and outlet flow rates are essentially continuous if power stroke time approximates the compression stroke time. Flow will, of course, stop momentarily at the ends of the strokes at which time the accumulators 53', 64' supply the flow demand. As shown the system 130 has the control valves set for operation in the primary mode. The operation insofar as intermittent cycling with a pause period, as was described above, the starting, and the general operation of the system 130 using both FPEP's 1*a'*, 1*b'* operating out of phase with each other or using only one of them at a time will be substantially the same as is described above, and, if desired, the acceleration boost and energy absorbing features described above also may be included in the system 130. Furthermore, the system 130 may be operated in the manner described above in the secondary mode, for example, by opening the control valves 68*a'*, 68*b'*, 69*a'*, 69*b'*, and closing the control valves 67*a'*, 67*b'*.

To operate, for example, only the FPEP 1*a'*, while the FPEP 1*b'* is disabled, the control valve 67*b'* would be closed while the control valve 67*a'* remains open to permit operation, say in the primary mode, or the FPEP 1*b'* is operated in the secondary mode, as was described above.

Cylinder air compression requirements are well known by those involved in the design of diesel engines. The primary purpose of compressing the cylinder air charge is to increase its pressure and associated temperature to an adequate level for ignition of the diesel fuel when it is injected. This requirement varies depending on conditions such as the initial temperature of the cylinder and air and the pressure level of the inlet air charge.

In a free piston engine, as well as in other diesel engines, the final condition of the air charge in the cylinder when compressed is directly related to the initial cylinder volume at the point of inlet port closing divided by the final cylinder volume. This is termed the compression ratio of the engine and is generally fixed in the rotary engine design or variable in some specific applications by mechanical means or by a limited hydraulic control means in the piston proper. The mechanizations to date have been limited in flexibility and have generally been designed for specific purposes such as to restrict peak cylinder pressures and avoid structural failures or for experimental purposes.

The opposed piston free piston engine pump 1 disclosed has unique capabilities and flexibilities in this area. They are the provision of total control over the amount of energy put into compression to establish compression ratio and related pressure and temperature conditions within the cylinder, thereby optimizing overall efficiency of the system, minimizing compression losses, and controlling operating pressure profile within the cylinder, and the provision of control over the rate at which the compression energy is applied which establishes the velocity and acceleration profiles of the piston on the compression stroke and results in cycle rate variability.

Figure 7:
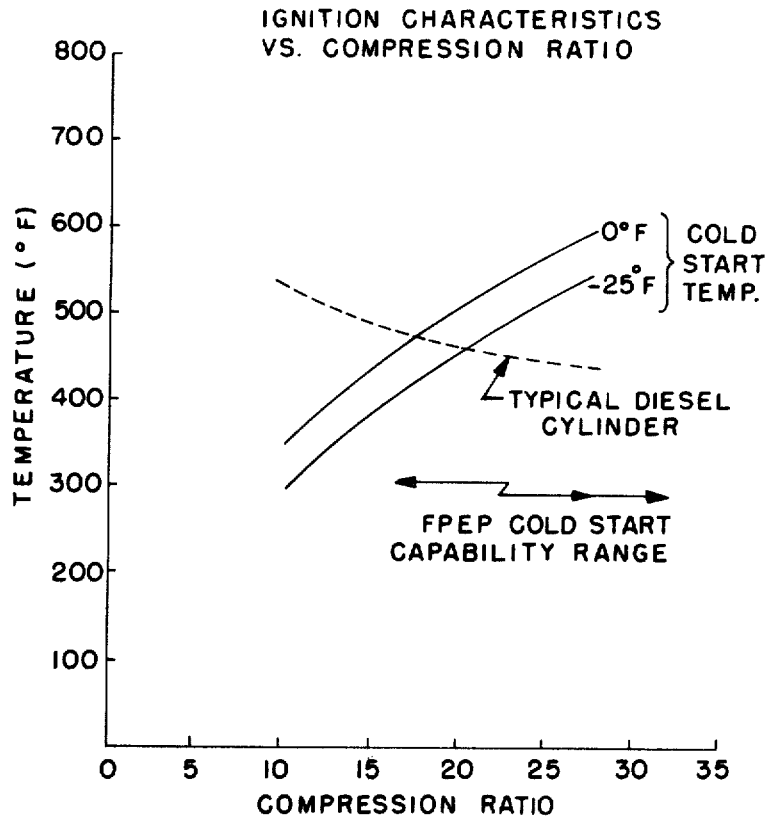
FIGS. 7–12 are graphs showing characteristics of diesel engines.
Figure 8:
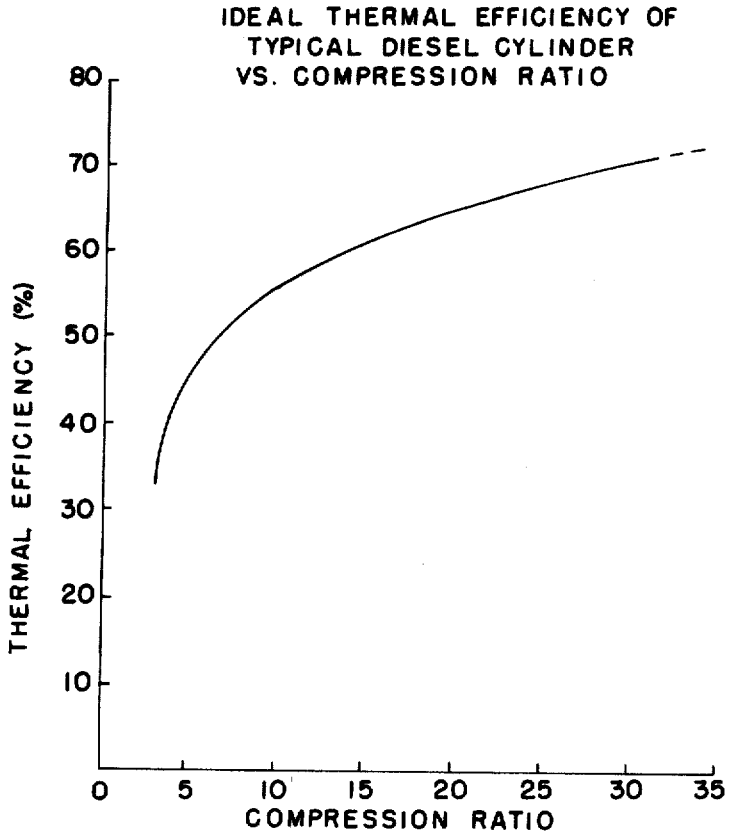
Figure 9:
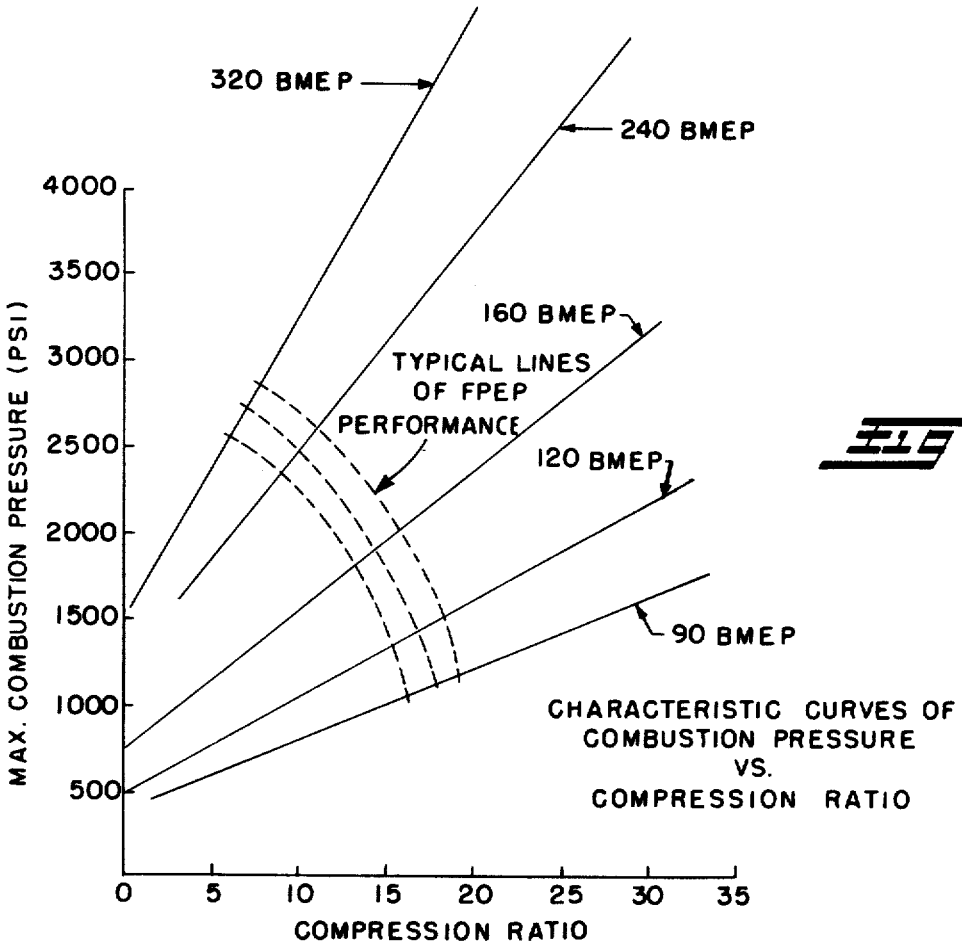

Typical diesel engine cylinder characteristics and their relationship to compression ratio are shown in FIGS. 7–9. These are shown as background information to establish the compression energy requirements and demonstrate the flexibility of the FPEP disclosed. FIG.

7 shows the relationship between compression ratio and cylinder gas temperature for cold start-up of a typical diesel cylinder. The opposed piston FPEP 1 is designed to achieve an equivalent cold start compression ratio in the range of 20 to 30 or higher.

The ideal thermal efficiency relationship of a typical diesel cylinder is shown in FIG. 8. It is seen that the improvement rate in efficiency declines substantially after a ratio of 8 or 10 is achieved.

FIG. 9 shows a plot of characteristic peak cylinder combustion pressure that can be expected vs. compression ratio for various brake mean effective pressures. Typical FPEP operating lines are shown. The characteristic BMEP lines show dramatically that compression ratio has a great impact on cylinder peak pressure level. The opposed piston FPEP 1 of the present invention compression energy implementation controls the peak pressure levels within the limitations of the design while maintaining high thermal efficiencies. Extremely high peak cylinder pressures can readily be supported by the FPEP 1. The combustion chamber is structurally suited for high pressure containment. Piston forces are transferred directly into hydraulic forces and acceleration of the piston elements. No crank arm or other linkage exists to resist the high acceleration forces on the piston.

Figure 10:
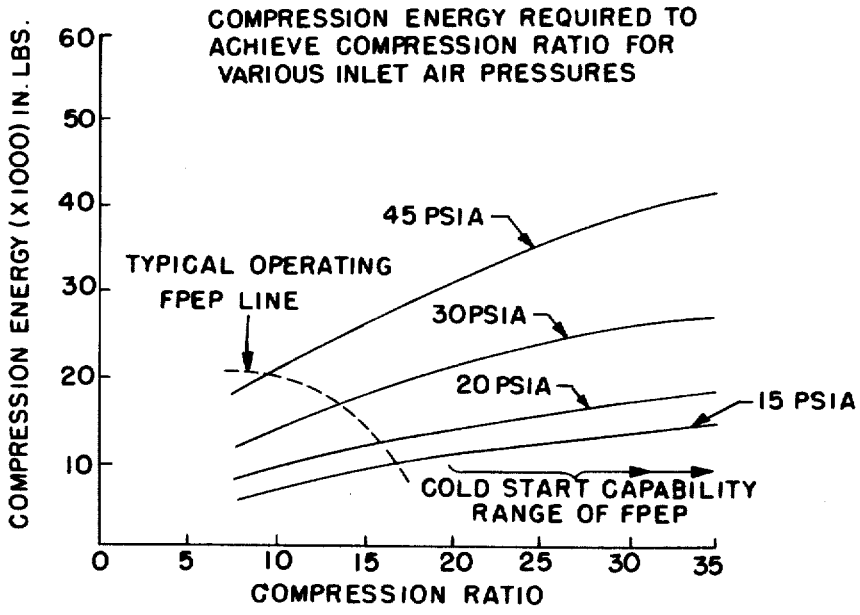

FIG. 10 shows a typical FPEP plot of compression energy required vs. compression ratio for various cylinder air charge pressures.

The compression energy is stored as compressed gas in the compression accumulator 49 (FIG. 1). The amount of energy available for compression is approximately defined by the following relationship:

$$E_C = \frac{P_2V_2}{n-1}\left[\left(\frac{V_2}{V_1}\right)^{n-1} - 1\right]$$

where

P = Accumulator gas pressure

V = Accumulator gas volume n = Equivalent gas constant and subscripts refer to initial condition (1) at start of compression stroke and final condition (2) at end of compression stroke.

An operating line has been added to FIG. 10 showing a typical optimized control condition for best overall efficiency. This line is established by actual test results obtained for a specific engine application. Also shown on FIG. 10 is the cold start capability region of the design.

Figure 11:
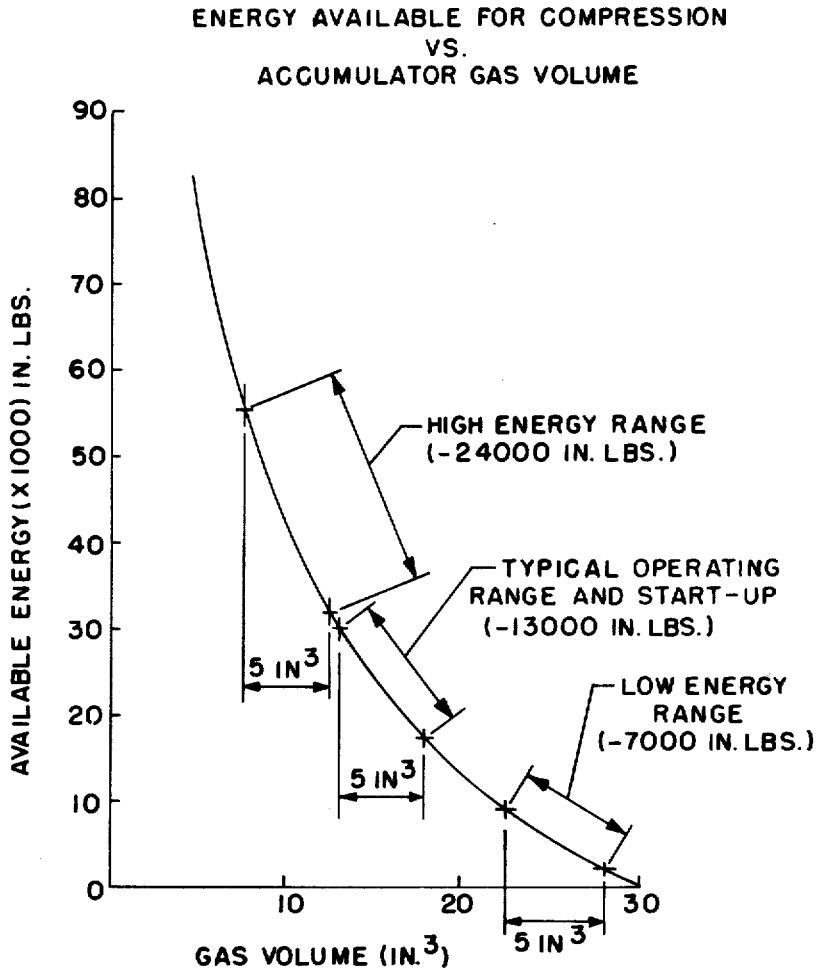

The energy that is available for compression and is stored in the compression accumulator is shown in FIG. 11. The characteristic shown is based on an accumulator gas charge volume of 30 $in^3$ and pre-charge pressure of 1000 psi. In the example shown, the working displaced volume has been selected as 5 $in^3$.

A pressure control valve 70 as shown in FIG. 1 establishes the nominal pressure level of the compression accumulator. This is varied during operation so that the predetermined performance requirements are achieved. The pressure control valve 70 receives its information from the electronic microprocessor control center as described below. By raising or lowering the pressure level in the compression accumulator 49, the compression energy is varied by as much as 3 to 1 or more, as shown in FIG. 11 for example. This adequately covers the operating requirements indicated in FIG. 10 which varies by approximately 2 to 1. In the secondary mode of operation, some of the energy for compression is supplied by the output pressure accumulator 53 as explained earlier. The amount of energy required of the compression accumulator 49 is, therefore, decreased toward the low energy range shown in FIG. 11.

Figure 12:
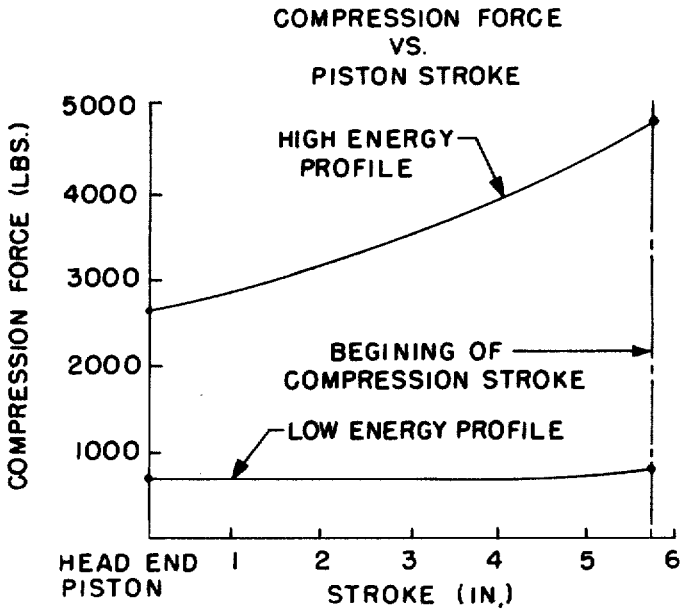

FIG. 12 shows how the pressure force applied to the piston mass (42, 46, 5) varies with stroke and energy level. As the net energy level is raised by increasing the working pressure of the compression accumulator 49, the initial force at the start of the compression stroke increases significantly with respect to the final force level. the advantageous result of this profile change is that the initial acceleration of the piston mass increases substantially. This provides an effective acceleration control means for "speeding up" the compression stroke time and resultant cycle rate.

Figures 13, 14:
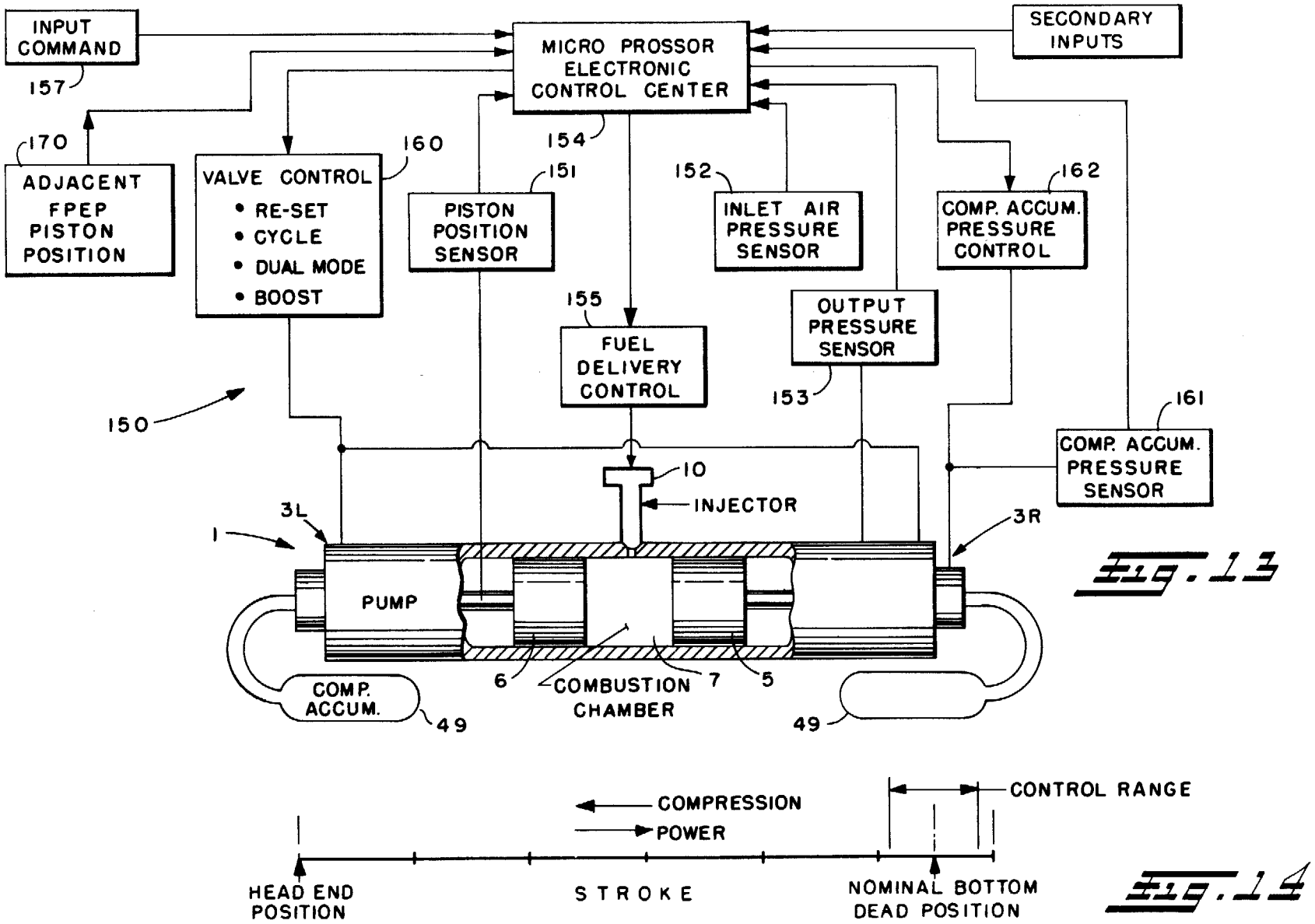
FIG. 13 is a schematic illustration of a FPEP in accordance with the invention and a schematic block diagram of an electronic monitoring and control system in accordance with the present invention.
FIG. 14 is a graph representing operational constraints of the FPEP and electronic system of FIG. 13.

In FIG. 13 the basic elements of the primary control circuit 150 are illustrated in association with the FPEP 1. Only primary inputs to the microprocessor electronic control center 154 are indicated along with the outputs that control FPEP operation. Other inputs to the electronic control 154 of secondary importance also may exist; these would be expected usually to have only low priority influence on the output signals. The secondary inputs include such information as intake and exhaust manifold temperatures, exhaust pressure, other oil pressures and temperatures, and failure detection sensors.

The primary control loop accomplishes the following functions. The primary control loop provides means of regulating the cycle-by-cycle operation of the FPEP 1 to achieve consistent operation and optimized performance potential for all hydraulic pressure and flow demands within its design range. The delivery of the FPEP may be controlled in an efficient manner including cycle rate variability with turn-down ratio of 100 to 1 or greater. Also, the compression energy and resultant compression ratio required by the engine combustion process may be controlled to achieve the most efficient operating potential over all power output levels including inlet air supercharge pressure levels of three atmospheres and greater. The control loop provides means of quickly positioning the engine-pump elements for start-up as well as a method of controlling the dual pumping feature of the pump to provide a smooth transition between primary high flow low pressure mode of operation and secondary low flow high pressure mode of operation. Using the primary control loop the compression energy may be substantially increased at the first part of the compression stroke to accelerate the cycle rate and increase the pumping rate capability of the FPEP 1. Moreover, the FPEP module cycle rate may be synchronized with that of adjacent FPEP module cycle rates for the purpose of providing continuous hydraulic input and output flow.

For cycle optimization the opposed piston FPEP 1 has the flexibility of varying the bottom dead position (start of compression stroke) as required to optimize the energy output process. FIG. 14 indicates that a control range exists around the nominal bottom dead position of the stroke for various power levels and cycle rates when optimizing overall performance. The interrelationship of factors that shape the combustion gas diesel cycle such as intake and exhaust port areas, inlet air pressure level and output power level can be optimized by varying the bottom dead position as determined by actual test data and programmed into the logic of the electronic microprocessor control 154.

Referring further to FIG. 13, piston position, inlet air charge pressure, and output pressure level are the primary engine sensor inputs 151-153 to the electronic control 154. Based on the predetermined algorithm for these system parameters, the injector fuel delivery control 155 operation is varied as required to establish the required operational stroke length.

For power delivery control, hydraulic power output from the FPEP 1 is regulated by input command control 157 and output pressure level rate of decay information sensed by pressure sensor 153. The input command 157 coming from operator or overall system needs requests an output pressure level. As pressure falls below this level, the FPEP 1 cycles as necessary to regain the level. The electronic control 154 determines the cycle rate, fuel delivery setting, and air charge pressure required to meet the need based on the rate of pressure level decay by controlling the fuel delivery control 155 and fuel injector 10, the desired supercharging, and the pump control valves 160 (such as the valves 67-69, 78, and 103 of FIGS. 1, 4 and 5A).

Compression energy level may be controlled based on preprogrammed information stored in the electronic control 154 in order to adjust the pressure level of the compression accumulator 49 for optimized compression. The sensor 161 senses compression accumulator pressure and this is correlated with the information received by the electronic control 154 from the input command 157, inlet air pressure sensor 152 and output pressure sensor 153 to operate the pressure control valve 162 which either raises or lowers the pressure level as required for the particular mode of operation.

For start-up, the electronic control 154 logic determines whether the FPEP 1 should be started based on information including operator input 157, output 153 and compression 161 accumulator pressures, inlet air pressure 152 and piston positions 151. If conditions are satisfied, the FPEP pistons 5, 6 will be reset, the reset valve 78 will be closed, and the start cycle will be initiated.

Mode selection can be made by either external operator input 157 or by automatic electronic control via sensors 152, 153, 161 depending on hydraulic pressure/-flow load requirements. When mode changing is required, output 53 and compression 49 accumulator pressures are sensed and inlet air charge pressure to the combustion chamber 7 must be read; necessary adjustments are made prior to switching the control valves 67-69 by the electronic control 154, for example, which also preferably adjusts the compression accumulator 49 pressure and appropriately controls the fuel injector 10 to accomplish change and mode of operation.

Depending on hydraulic system needs, higher flows may be achieved by activating the acceleration booster 100. This is accomplished automatically by the electronic control 154 if flow rate cannot keep up with demand. Accordingly the input command 157, output pressure and decay rate from sensor 153 and compression accumulator 49 pressure from sensor 161 are monitored by the electronic control 154 which in turn effects appropriate operation of the pump boost control valve 103, fuel delivery controller 155, and compression accumulator pressure control 162.

Two or more FPEP modules 1 within an installation may be synchronized by slight piston stroke length changes in one module as compared with another as reference. By changing fuel delivery 155 slightly, the piston stroke length 151 is decreased or increased as required to change the cycle rate of the module in tune with the reference module 170.

In view of the foregoing, the versatility of the FPEP 1 as used alone or in combination with other FPEP's incorporating one or more of the various features described above to effect pumping of hydraulic fluid to do work, for example, for a variety of purposes, now will be appreciated.

I claim:

1. A free piston engine pump system comprising free piston engine means for producing output work, pump means responsive to such output work for producing a hydraulic output, said pump means comprising a pump cylinder, a pump piston movable in said pump cylinder, and reset means for resetting said pump piston to a predetermined position in said pump cylinder, said reset means comprising a fluid pressure intensifier.

2. A grouped free piston engine pump system, comprising at least two free piston engine pumps, each including a free piston engine having an engine cylinder and engine piston means for reciprocating said engine cylinder to produce work, and fluid pump means responsive to such work for pumping fluid and having a pump cylinder and a pump piston means for pumping fluid, said pump piston means dividing said pump cylinder into first and second pump chambers; a first common supply means for supplying all said first pump chambers with inlet fluid at relatively low pressure; second common supply means for supplying all said second pump chambers with inlet fluid at relatively low pressure; first common outlet means for coupling in fluid parallel relationship relatively high pressure fluid pumped by respective pump piston means from said first pump chambers; and valve means for controlling flow of fluid in said supply and outlet means, said valve means for each respective pump means comprising first check valve means for passing inlet flow of relatively low pressure fluid to said first pump chamber, second check valve means for passing outlet flow of relatively high pressure fluid from said first pump chamber, first selectively operable valve means fluidically in parallel with said second check valve means for selectively bypassing the latter, third and fourth check valve means respectively for passing inlet flow of relatively low pressure fluid to said second chamber and outlet flow of relatively high pressure fluid from said second pump chamber, second selectively operable valve means fluidically in parallel with said third check valve means for selectively bypassing the latter, and third selectively operable valve means fluidically in series with said fourth check valve means for selectively controlling fluid flow through the latter.

3. A free piston engine pump system comprising free piston engine means for producing output work, pump means responsive to such output work for producing a hydraulic output, said pump means comprising a pump cylinder and a pump piston movable in said pump cylinder, and a reset apparatus for resetting said pump means, including an inlet fluid chamber and an outlet fluid chamber, a reset piston having a relatively large surface area exposed to fluid in said inlet fluid chamber and a relatively small surface area exposed to fluid in said outlet fluid chamber, means for setting said reset piston to a position reducing the size of said inlet fluid chamber and enlarging the size of said outlet fluid chamber, means for substantially filling said outlet fluid chamber with fluid, means for fluidically coupling said outlet fluid chamber to said pump means, and means for supplying fluid to said inlet fluid chamber to move said reset piston to force fluid via said means for fluidically coupling to move said pump piston to a predetermined position in said pump cylinder.

4. The system of claim 3, wherein said means for substantially filling comprises a fluid flow path through said reset piston and a check valve means in said fluid flow path for permitting flow of fluid from said inlet fluid chamber to said outlet fluid chamber as said means for resetting moves said reset piston.

5. A free piston engine pump system comprising free piston engine means for producing output work, pump means responsive to such output work for producing a hydraulic output, and selectively actuable acceleration boost means for increasing initial acceleration of said free piston engine means in a compression stroke, including boost piston means engageable with said free piston engine means to be moved in one direction during a power stroke and during the beginning of a compression stroke to supply said work to said free piston engine means tending to move the latter to effect compression and thereby accelerating the compression stroke, and fluid control means selectively operable to effect movement of said boost piston means in an activated position to effect such increased acceleration and to a deactivated position in which said boost piston means ordinarily is not engaged by said free piston engine means.

6. The system of claim 5, further comprising energy absorber means for absorbing excessive energy produced by overtravel of said free piston engine means, including an energy absorber piston contactable with said boost piston means when the latter is in its activated mode and has been moved by said free piston engine means at least a predetermined distance.

7. The system of claim 6, wherein said energy absorber means further comprises means for positioning said energy absorber piston in alignment with said boost piston means and in engagement with the latter when in deactivated position, and said boost piston means including rod means positioned when deactivated for engagement by said free piston engine means when the latter travels an excessive distance during a power stroke.

8. A grouped free piston engine pump system, comprising at least two free piston engine pumps, each including a free piston engine having an engine cylinder and engine piston means for reciprocating said engine cylinder to produce work, and fluid pump means responsive to such work for pumping fluid and having a pump cylinder and a pump piston means for pumping fluid, said pump piston means dividing said pump cylinder into first and second pump chambers; a first common supply means for supplying all said first pump chambers with inlet fluid at relatively low pressure; second common supply means for supplying all said second pump chambers with inlet fluid at relatively low pressure; first common outlet means for coupling in fluid parallel relationship relatively high pressure fluid pumped by respective pump piston means from said first pump chambers; and valve means for controlling flow of fluid in said supply and outlet means, said valve means comprising means for permitting unimpeded flow of fluid between said second pump chambers, and said free piston engine pumps comprise a pair of the same and means for controlling operation of said free piston engine pumps to effect out-of phase operation whereby as fluid is pumped from one second pump chamber it fills the other second pump chamber.

9. The system of claim 8, further comprising second common outlet means for said second pump chambers.

10. The system of claim 8, wherein each free piston engine pump comprises an engine cylinder having a linear axis, two engine pistons movable in said engine cylinder along such axis toward each other during a compression stroke and away from each other during a power stroke, a separate pump means associated with each engine piston for pumping fluid, each pump means including a pump cylinder axially aligned with said engine cylinder, and a pump piston means coupled to a respective engine piston for movement therewith, said valve means controlling flow of fluid into and out from said pump chambers.

11. The system of claim 8, further comprising a compression accumulator including a relatively rigid housing, fluid coupling means for coupling a first fluid into and out from said housing, a deformable member in said housing forming a substantially fluid-tight container therein, a medium in said container capable of compressing to store energy in response to pressure exerted on said container by such first fluid during a power stroke and of expanding to expand said container thereby to deliver energy to such first fluid for effecting a compression stroke.

12. A free piston engine pump system comprising free piston engine means for producing work, and pump means responsive to such work for producing a hydraulic output, said pump means comprising a pump cylinder, a pump piston movable in said cylinder and defining first and second pump chambers therein, and valve means for controlling flow of fluid into and out of said pump chambers, said valve means comprising first check valve means for passing inlet flow of relatively low pressure fluid to said first pump chamber, second check valve means for passing outlet flow of relatively high pressure fluid from said first pump chamber, first selectively operable valve means fluidically in parallel with said second check valve means for selectively bypassing the latter, third and fourth check valve means respectively for passing inlet flow of relatively low pressure fluid to said second chamber and outlet flow of relatively high pressure fluid from said second pump chamber, second selectively operable valve means fluidically in parallel with said third check valve means for selectively bypassing the latter, and third selectively operable valve means fluidically in series with said fourth check valve means for selectively controlling fluid flow through the latter.

13. The system of claim 12, wherein said engine comprises an engine cylinder and engine piston means for reciprocating in said engine cylinder during compression and power strokes, said pump piston being coupled to said engine piston means, and said valve means comprises means for effecting a pressure lock and release selectively to control the cycle rate of said engine means.

14. The system of claim 12, further comprising a compression accumulator including a relatively rigid housing, fluid coupling means for coupling a first fluid into and out from said housing, a deformable member in said housing forming a substantially fluid-tight container therein, a medium in said container capable of compressing to store energy in response to pressure exerted on such container by said first fluid during a power stroke and of expanding to expand said container thereby to deliver energy to such first fluid for effecting a compression stroke.

15. The system of claim 12, wherein said free piston engine means includes an engine cylinder having a linear axis, two pistons movable in said engine cylinder along such axis toward each other during a compression stroke and away from each other during a power stroke, and said pump means comprises a separate pump means associated with each engine piston, each pump means including its own pump cylinder axially aligned with said engine cylinder, and each respective pump piston comprising a pump piston coupled to a respective engine piston for movement therewith.

16. A free piston engine comprising an engine cylinder, engine piston means movable in said engine cylinder in one direction during a compression stroke and in an opposite direction during a power stroke for producing work, and selectively actuable acceleration boost means for increasing initial acceleration of said engine piston means in a compression stroke, including boost piston means engageable with said engine piston means to be moved in one direction during a power stroke and during the beginning of a compression stroke to apply work to said engine piston means tending to move the latter to effect compression, and fluid control means selectively operable to effect movement of said boost piston means in an activated position to effect such increased acceleration and to a deactivated position in which said boost piston means ordinarily is not engaged by said engine piston means.

17. The engine of claim 16, further comprising energy absorber means for absorbing excessive energy produced by overtravel of said engine piston means, including an energy absorber piston contactable with said boost piston means when the latter is in its activated mode and has been moved by said engine piston means at least a predetermined distance.

18. The engine of claim 17, wherein said energy absorber means further comprises means for positioning said energy absorber piston in alignment with said boost piston means and in engagement with the latter when in deactivated position, and said boost piston means includes rod means positioned when said boost piston means is deactivated for engagement by said engine piston means when the latter travels an excessive distance during a power stroke.

19. The engine of claim 17, wherein said energy absorber means comprises a fluid spring.

20. The engine of claim 19, wherein said fluid spring comprises an absorber chamber in which said energy absorber piston is movable and a fluid path through said energy absorber piston and a check valve therein for filling said absorber chamber with fluid when said energy absorber piston is released from force applied by said engine piston means.

21. A reset apparatus for resetting a fluid pump having a pump piston for reciprocating in a pump cylinder to pump fluid and forming plural pump chambers in said pump cylinder, comprising an inlet fluid chamber and an outlet fluid chamber, a reset piston having a relatively large surface area exposed to fluid in said inlet fluid chamber and a relatively small surface area exposed to fluid in said outlet fluid chamber, means for setting said reset piston to a position reducing the size of said inlet fluid chamber and enlarging the size of said outlet fluid chamber, means for substantially filling said outlet fluid chamber with fluid, means for fluidically coupling said outlet fluid chamber to one of said pump chambers, and means for supplying fluid to said inlet fluid chamber to move said reset piston to force fluid via said means for fluidically coupling to move said pump piston to a predetermined position in said pump cylinder.

22. The apparatus of claim 21, wherein said reset piston and inlet and outlet fluid chambers comprise a fluid pressure intensifier.

23. The apparatus of claim 21, wherein said means for substantially filling comprises a fluid flow path through said reset piston and a check valve means in said fluid flow path for permitting flow of fluid from said inlet fluid chamber to said outlet fluid chamber as said means for setting moves said reset piston.

24. The apparatus of claim 23, wherein said means for setting comprises a spring.

25. The apparatus of claim 23, wherein said means for supplying comprises selectively operable valve means for coupling in one condition a supply of relatively high pressure fluid to said inlet fluid chamber to move said reset piston and means for coupling the other of said pump chambers to relatively low fluid pressure and for coupling in another condition said inlet fluid chamber to relatively low fluid pressure enabling said means for setting to move said reset piston.

26. An in line opposed piston free piston engine pump system comprising a free piston engine including an engine cylinder having a linear axis, a pair of engine pistons movable in said engine cylinder along such axis toward each other during a compression stroke and away from each other during a power stroke; a separate pump means associated with each engine piston for pumping fluid, each pump means including a pump cylinder axially aligned with said engine cylinder, a pump piston coupled to a respective engine piston for movement therewith and forming first and second pump chambers within said pump cylinder, and valve means for controlling flow of fluid into and out of said pump chambers, and valve means comprising first check valve means for passing inlet flow of relatively low pressure fluid to said first pump chamber, second check valve means for passing outlet flow of relatively high pressure fluid from said first pump chamber, first selectively operable valve means fluidically in parallel with said second check valve means for selectively bypassing the latter, third and fourth check valve means respectively for passing inlet flow of relatively low pressure fluid to said second pump chamber and outlet flow of relatively high pressure fluid from said second pump chamber, second selectively operable valve means fluidically in parallel with said third check valve means for selectively bypassing the latter, and third selectively operable valve means fluidically in series with said fourth check valve means for selectively controlling fluid flow through the latter.

27. The system of claim 26, further comprising sensor means for monitoring at least one parameter of said engine means and pump means, and electronic control means responsive to said sensor means for controlling at least one operation of said engine means and pump means.

28. The free piston engine pump system of claim 26, further comprising a further free piston engine pump having inlet and outlet fluid flow lines coupled in parallel with the first free piston engine pump, said further free piston engine pump including an engine cylinder having a linear axis, two engine pistons movable in said engine cylinder along such axis toward each other during a compression stroke and away from each other during a power stroke, and a separate pump means associated with each engine piston for pumping fluid, and control means for controlling operation of said free piston engine pumps.

29. The free piston engine pump system of claim 26, further comprising a compression accumulator including a relatively rigid housing, fluid coupling means for coupling a first fluid into and out from said housing, a deformable member in said housing forming a substantially fluid-tight container therein, a medium in said container capable of compressing to store energy in response to pressure exerted on such container by such first fluid during a power stroke and of expanding to expand said container thereby to deliver energy to such first fluid for effecting a compression stroke.

30. The free piston engine pump system of claim 26, further comprising exhaust port means in said engine cylinder proximate one end thereof relative to the ordinarily expected maximum displacement of one engine piston during a power stroke to be opened by such displacement for discharging exhaust products of combustion from said engine cylinder and air inlet port means proximate the opposite end of said engine cylinder relative to the ordinarily expected maximum displacement of the other engine piston during the power stroke to be opened by the latter engine piston to supply air for combustion in said engine cylinder, whereby said port means provide unidirectional scavenging in said engine cylinder.

31. The free piston engine pump system of claim 26, further comprising synchronizing means for maintaining synchronized movement of said engine pistons normally without transferring substantial force therebetween thereby substantially to maintain balanced the relatively center of mass of the engine.

32. The free piston engine pump system of claim 31, wherein said synchronizing means comprises a rack and pinion assembly.

33. A pump system comprising a pump cylinder, a pump piston movable in said pump cylinder and defining first and second pump chambers therein, and valve means for controlling flow of fluid into and out from said pump chambers, said valve means including first check valve means for passing inlet flow of relatively low pressure fluid to said first pump chamber, second check valve means for passing outlet flow of relatively high pressure fluid from said first pump chamber, first selectively operable valve means fluidically in parallel with said second check valve means for selectively bypassing the latter, third and fourth check valve means respectively for passing inlet flow of relatively low pressure fluid to said second chamber and outlet flow of relatively high pressure fluid from said second pump chamber, second selectively operable valve means fluidically in parallel with said third check valve means for selectively bypassing the latter, and third selectively operable valve means fluidically in series with said fourth check valve means for selectively controlling fluid flow through the latter.

34. The system of claim 33, wherein said selectively operable valve means comprises electrohydraulic valves.

35. The system of claim 33, wherein said valve means is fluidically coupled relative to said pump chambers to enable selective operation of said pump in a high pressure mode and in a high flow mode.

36. The system of claim 33, wherein said selectively operable valve means is fluidically coupled relative to said check valve means and pump chambers to enable selective operation of said pump in a high pressure mode and in a high flow mode, and further comprising inlet fluid flow means for coupling to said pump relatively low pressure input fluid, said inlet fluid flow means being coupled to provide such input fluid to said first check valve means and to the parallel connected third check valve means and second selectively operable valve means, and outlet fluid flow means for coupling together and to a relatively high pressure fluid outlet said parallel connected second check valve means and first selectively operable valve means and said series connected fourth check valve means and third selectively operable valve means.

37. The system of claim 33, further comprising sensor means for monitoring at least one parameter of said engine means and pump means, and electronic control means responsive to said sensor means for controlling at least one operation of said engine means and pump means.

38. The system of claim 37, wherein said electronic control means comprises a microprocessor.

39. The system of claim 37, further comprising a further free piston engine pump system including engine means and pump means, and said electronic control means includes means for controlling at least one operation of all of said engine means and pump means.

40. The system of claim 37, wherein said free piston engine means includes plural engine pistons, fuel delivery means for delivering fuel for combustion, air delivery means for delivering air for combustion, said pump means including pump piston means for pumping fluid to a fluid outlet, a compression accumulator means for storing energy during pumping of said pump piston means and for returning such energy to effect compression stroke in said engine means, and wherein said sensor means includes means for sensing the position of said engine piston means, the position of said pump piston means, the pressure of air delivered to said engine means, and the pressure in said compression accumulator means.

41. The system of claim 40, further comprising control means for controlling the delivery of fuel to said engine means and pressure in said compression accumulator means.

42. The system of claim 37, further comprising a compression accumulator including a relatively rigid housing, fluid coupling means for coupling a first fluid into and out from said housing, a deformable member in said housing forming a substantially fluid-tight container therein, a medium in said container capable of compressing to store energy in response to pressure exerted on said container by such first fluid during a power stroke and of expanding to expand said container thereby to deliver energy to such first fluid for effecting a compression stroke.

43. The system of claim 42, wherein said electronic control means includes means for controlling the pressure of said compression accumulator.

44. The system of claim 37, further comprising valve means for controlling flow of fluid into and from said pump means.

45. The system of claim 44, wherein said electronic control means includes means for operating said valve means selectively to operate said pump means in high flow and in high pressure modes.

46. The system of claim 44, wherein said electronic control means includes means for operating said valve means selectively to control the cycle rate of said engine means.

47. The system of claim 44, wherein said electronic control means includes means for controlling said valve means to reset said engine means and pump means for starting.

48. The system of claim 44, wherein said engine means and pump means include pistons, and said electronic control means includes means for controlling said valve means to boost acceleration of said pistons during a compression stroke.

49. The system of claim 44, wherein said electronic control means includes means for controlling fuel for flow through said engine means for maintaining substantially constant the period during which the compression stroke and power stroke occur.

50. The system of claim 49, further comprising an exhaust system for removing exhaust products of combustion from said engine means, said exhaust system being tuned for optimum operation according to such relatively constant cycle period.

51. The system of claim 49, wherein said exhaust system includes an exhaust turbine and an air compressor means driven by said exhaust turbine for compressing air prior to delivery thereof to said engine means for use in combustion therein.

* * * * *